United States Patent [19]

Coad

[11] Patent Number: 4,690,711

[45] Date of Patent: Sep. 1, 1987

[54] SINTERED COMPACT AND PROCESS FOR PRODUCING SAME

[75] Inventor: Brian C. Coad, San Francisco, Calif.

[73] Assignee: GTE Products Corporation, Stamford, Conn.

[21] Appl. No.: 865,303

[22] Filed: May 21, 1986

Related U.S. Application Data

[63] Continuation-in-part of Ser. No. 680,105, Dec. 10, 1984, abandoned.

[51] Int. Cl.[4] ..... C22C 19/05; C22C 38/18; C22C 38/32; C22C 38/54

[52] U.S. Cl. ..... 75/244; 75/246; 419/47; 420/43; 420/50; 420/64; 420/94; 420/97; 420/98; 420/104; 420/112; 420/117; 420/119; 420/441

[58] Field of Search ..... 419/10, 12, 38, 47; 75/244, 246, 123 R, 123 B, 123 K, 123 L, 126 R, 126 P, 126 Q, 128 R, 128 C, 128 F; 420/428, 441, , 442, 43, 50, 64, 94, 97, 98, 104, 112, 117, 119

[56] References Cited

U.S. PATENT DOCUMENTS

| | | | |
|---|---|---|---|
| 3,689,257 | 9/1972 | Oda et al. | 419/47 |
| 4,011,051 | 3/1977 | Helton et al. | 29/182 |
| 4,283,225 | 8/1981 | Sexton et al. | 75/170 |
| 4,402,742 | 9/1983 | Pattanaik | 75/123 B |
| 4,410,604 | 10/1983 | Pohlman et al. | 428/681 |
| 4,504,312 | 3/1985 | Oaku et al. | 75/244 |
| 4,516,716 | 5/1985 | Coad | 228/263.15 |
| 4,528,247 | 7/1985 | Mizuhara | 428/606 |
| 4,540,453 | 9/1985 | Boredelon et al. | 148/31.55 |
| 4,594,103 | 6/1986 | Simm et al. | 75/128 C |

*Primary Examiner*—John F. Terapane
*Assistant Examiner*—Eric Jorgensen
*Attorney, Agent, or Firm*—Donald R. Castle

[57] ABSTRACT

A process for preparing an iron group sintered compact involves forming an admixture of an iron group metal alloy powder additive and iron powder wherein the melting point of the alloy additive is at least about 50° C. lower than that of the iron, compacting the admixture to form a green compact, and sintering the green compact at a temperature of from about 20° C. above the solidus to about 100° C. above the liquidus of the alloy additive whereby a sintered compact is formed. A compact having an iron group alloy additive as a continuous phase and iron as a discontinuous phase wherein the continuous phase has a melting point of at least about 50° C. lower than that of the discontinuous phase can be prepared at lower sintering temperatures than a typical iron powder.

3 Claims, No Drawings

SINTERED COMPACT AND PROCESS FOR PRODUCING SAME

This application is a continuation-in-part of U.S. patent application Ser. No. 680,105, now abandoned filed Dec. 10, 1984 and assigned to the same assignee as the present application.

FIELD OF THE INVENTION

This invention relates to a process for preparing a sintered compact containing an iron group metals that is compacts containing iron, cobalt nickel or mixtures thereof. It also relates to the compact thus prepared which has an iron group metal alloy additive as a continuous phase and iron or iron base alloy as a discontinuous phase.

BACKGROUND OF THE INVENTION

The practice of forming an iron group metal parts and components by compaction of powder and sintering at high temperatures in the solid state has long been known in the art. The greatest portion of such parts and components are made from iron powder, which is typically sintered in the temperature range of about 1000° C. to about 1200°.

It has long been know that the sintering mechanism can be enhanced and can occur with equal effect at lower temperatures if a liquid metal phase is present during the sintering operation. In powder metallurgy, such liquid phases are generally restricted to copper, and certain copper alloys, for example, copper phosphide, added in quantities of about one or two percent by weight. Such additives do little or nothing to improve the intrinsic properties of the iron, but do permit higher strengths and higher densities to be achieved at lower sintering temperatures, and therefore a cost saving in parts requiring good physical properties. While copper alone only marginally reduces sintering temperatures (to about 1100° C.), copper alloys, which further reduce the temperature, for example, to about 970° C. for copper phosphide, are relatively expensive and less effective in property improvement.

It would be desirable to develop alloys which would have excellent wetting qualities on ferrous metal surfaces, and which add elements to the powder compact which improve strength and in some cases corrosion resistance and which are possible of lower cost than the copper alloys.

U.S. Pat. No. 3,689,257 pertains to the use of a Fe-Si sintering additive for use with higher melting point materials to produce an alloy which is a solid solution of all elements. The materials produced by the techniques described in that patent do not have two distinct phases.

U.S. Pat. No. 4,011,051 pertains to wear resistant alloy composites, however, it does not disclose a compact having iron as a discontinuous phase.

U.S. Pat. Nos. 4,283,225, 4,402,742 and 4,410,604 cited in the parent application pertain to various iron based brazing alloys and not to the compacts of this invention containing the recited phases.

U.S. Pat. No. 4,504,312 also pertains to a wear resistant alloy and does not disclose a material having the recited phases of this invention. The sintering is carried on for a sufficient time to form as alloy rather than a composite having distinct phases.

SUMMARY OF THE INVENTION

In accordance with one aspect of this invention there is provided a process for preparing an iron group metal sintered compact which involves forming an admixture of an iron group metal alloy powder additive and iron powder wherein the melting point of the alloy additive is at least about 50° C. lower than that of the iron, compacting the admixture to form a green compact and sintering the green compact at a temperature of from about 20° C. above the solidus to about 100° C. above the liquidus of the alloy additive to form the sintered compact.

In accordance with another aspect of this invention, there is provided a compact having an iron group metal alloy additive as a continuous phase and iron as a discontinuous phase wherein the continuous phase has a melting point of at least about 50° C. lower than that of the discontinuous phase.

DETAILED DESCRIPTION OF THE INVENTION

For a better understanding of the present invention, together with other and furthe objects, advantages, and capabilities thereof, reference is made to the following disclosure and appended claims in connection with the foregoing description of some of the aspects of the invention.

This invention relates to a process for preparing an metal sintered compact. It also relates to the compact thus prepared which has an iron metal alloy additive as a continuous phase and iron as a discontinous phase.

In the practice of this invention, suitable iron group metal alloy additives are atomized by well established techniques. As used herein iron group metals consist of iron, cobalt nickel and mixtures thereof. Typical alloy additive compositions are as follows, by weight: (1) from about 0% to about 12% silicon with from about 3% to about 10% being preferred; from about 0% to about 7% boron, with from about 2% to about 5% being preferred: and the balance nickel; and (2) from about 0% to about 12% silicon with from about 3% to about 10% being preferred; from about 0% to about 50% chromium with from about 6% to about 20% being preferred; from about 0% to about 7% boron with from about 2% to about 5% being preferred; and the balance nickel; (3) from about 0% to about 12% silicon with from about 3% to about 10% being preferred; from about 0% to about 50% chromium with from about 6% to about 20% being preferred; from about 0% to about 7% boron with from about 2% to about 5% being preferred; from about 0% to about 40% nickel with from about 8% to about 25% being preferred, and the balance iron. One especially preferred composition is as follows in percent, by weight. (1) about 6% silicon, about 4% boron, and the balance nickel; this alloy has a melting point of about 980° C. A second especially preferred composition is as follows in percent by weight about 4% boron, about 5% silicon, about 16% chromium, about 22.5% nickel and the balance iron. The melting point of this second preferred composition is about 1065° C. A third preferred composition is as follows in percent by weight about 0% boron, about 10% silicon, about 19% chromium, balance nickel. The melting point of this third preferred composition is about 1135° C. It is essential that the melting point of the alloy additive be at least about 50° C. lower than that of the iron powder which is from about 1500°

C. to about 1535° C. depending upon the purity. The preferred melting point ranges for the alloy additive are from about 950° C. to about 1200° C.

The iron group metal alloy additive is blended with iron powder to form an admixture. The composition of the admixture is generally from about 0.1% to about 10% by weight of the alloy additive with from about 0.5% to about 5% being preferred and the balance the iron powder.

The admixture is then compacted by conventional compacting techniques to form a green compact.

The green compact is then sintered at a temperature of from about 20° C. above the solidus to about 100° C. above the liquidus of the alloy additive to form a sintered compact. Generally about 5 minutes to about 120 minutes are required to give the proper density. During the sintering operation, the ferrous metal alloy additive is molten or partially molten thus enhancing sintering. Therefore, the resulting sintered compact is composed of the iron group metal alloy additive as the continuous phase and iron as the discontinuous phase with a degree of interphase diffusion which can be varied on controlling sintering time and/or temperature. Note also that if the low melting alloy contains chromium, the surfaces of the sintered particles will be rich in chromium and therefore unusually corrosion resistant. The presence of a liquid phase during sintering also enhances densification, and hence strength of the finished part.

While there has been shown and described what are at present considered the preferred embodiments of the invention, it will be obvious to those skilled in the art that various changes and modifications may be made therein without departing from the scope of the invention as defined by the appended claims.

What is claimed is:

1. A compact having an iron group alloy additive selected from a nickel boron-silicon alloy having nickel as the major element and an iron-silicon-chromium-nickel alloy having iron as the major element as a continuous phase and iron as a discontinuous phase wherein said additive has a melting point of at least about 50° C. lower than that of the discontinuous phase.

2. A compact according to claim 1 wherein the alloy additive melts at a temperature of from about 950° C. to about 1200° C.

3. A compact according to claim 1 wherein the alloy additive consists essentially of, by weight from about 3% to about 10% silicon, from about 2% to about 5% boron and the balance nickel.

* * * * *